US005479146A

United States Patent [19]

Herbert

[11] Patent Number: 5,479,146

[45] Date of Patent: Dec. 26, 1995

[54] POT CORE MATRIX TRANSFORMER HAVING IMPROVED HEAT REJECTION

[75] Inventor: Edward Herbert, Canton, Conn.

[73] Assignee: FMTT, Inc., Canton, Conn.

[21] Appl. No.: 95,663

[22] Filed: Jul. 21, 1993

[51] Int. Cl.[6] ..... H01F 15/06

[52] U.S. Cl. ..... 336/61; 336/65; 336/200; 336/192; 174/265; 361/799

[58] Field of Search ..... 336/61, 65, 82, 336/192, 200; 174/262, 265; 361/752, 799

[56] References Cited

U.S. PATENT DOCUMENTS 4,484,170 11/1984 Wirth et al. ..... 336/65
4,616,205 10/1986 Praught et al. ..... 336/82
5,321,380 6/1994 Godek et al. ..... 336/232
5,345,670 9/1994 Pitzele et al. ..... 29/606
5,359,313 10/1994 Watanabe et al. ..... 336/178

*Primary Examiner*—Laura Thomas

[57] ABSTRACT

A pot core matrix transformer has a large number of connections from its secondary winding, the connections being fairly evenly distributed around the bottom surface. If these connections are terminated in a circuit board which has been optimized for good thermal conductivity, the temperature rise in the transformer will be small, even with very high current densities. Embodiments are shown for mounting directly on a heat sink and for surface mounting on a circuit card.

9 Claims, 6 Drawing Sheets

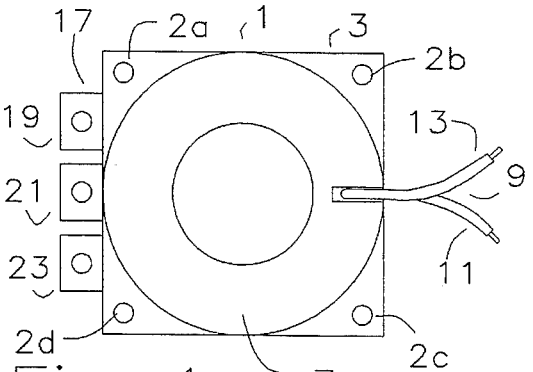
Fig. 1
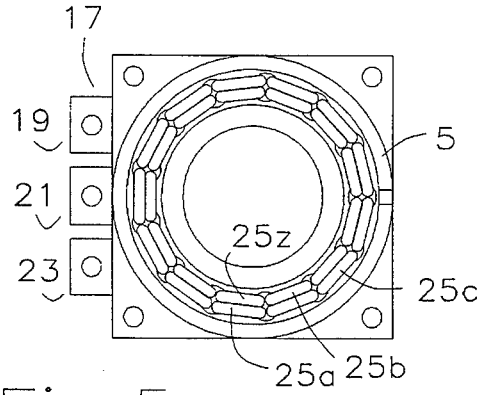
Fig 5
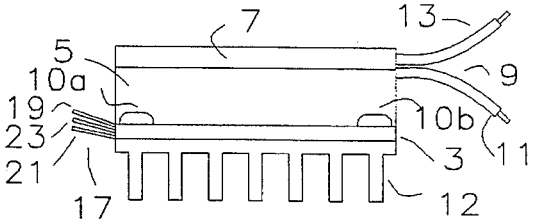
Fig. 2
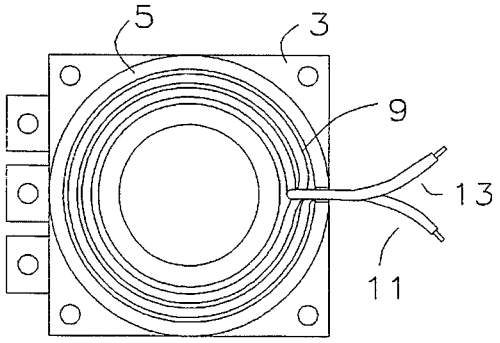
Fig. 6
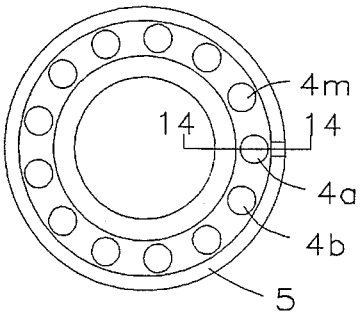
Fig. 3
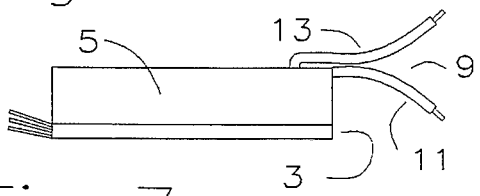
Fig. 7
Fig. 4
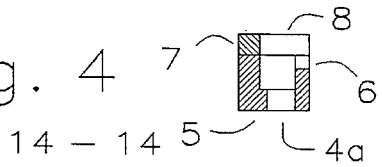

200 – 200

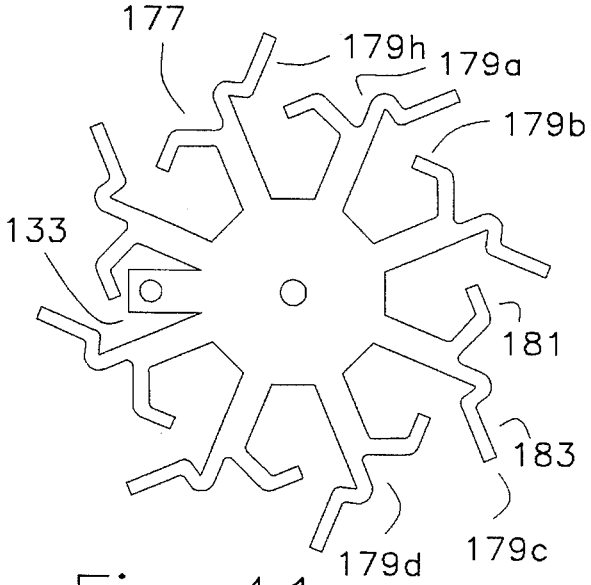
Fig. 41
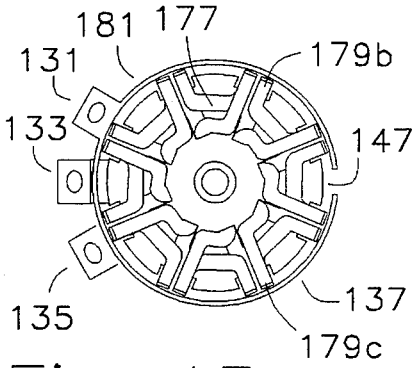
Fig. 43
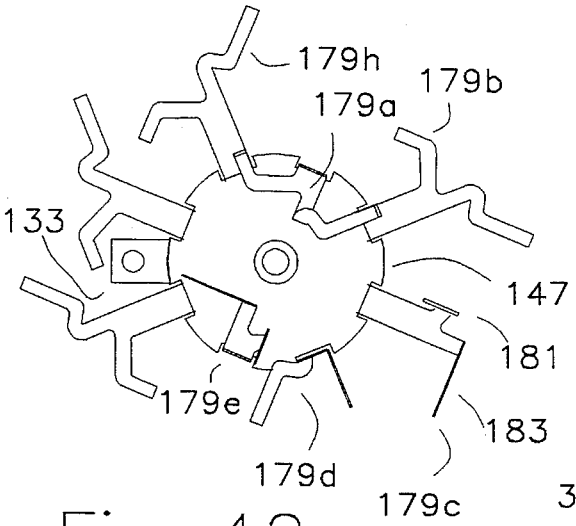
Fig. 42
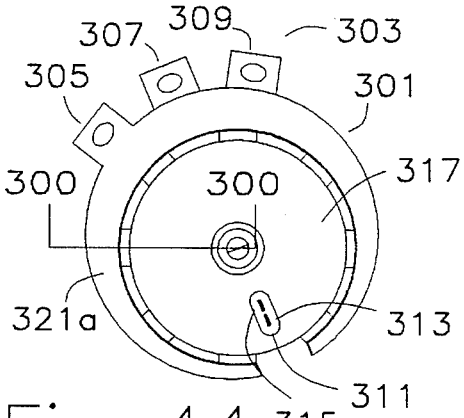
Fig. 44
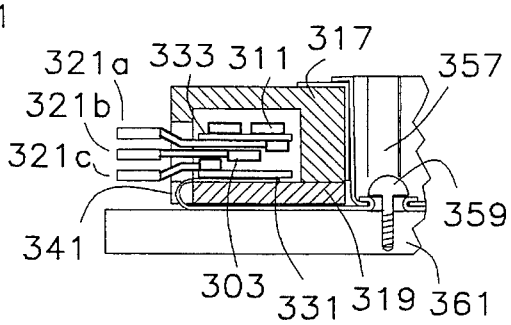
Fig. 45 300 – 300

POT CORE MATRIX TRANSFORMER HAVING IMPROVED HEAT REJECTION

BACKGROUND OF THE INVENTION

This invention relates generally to transformers and inductors, and in particular to picture frame matrix transformer and inductors.

The art of transformers and inductors of conventional construction is well known. A recent variant having a low profile is known as the "planar" transformer.

U.S. Pat. No. 4,665,357 "Flat Matrix Transformers" teaches the art of matrix transformers and inductors.

U.S. Pat. No. 4,845,606 "High Frequency Matrix Transformers" and U.S. Pat. No. 5,093,646 "High Frequency Matrix Transformers" teach embodiments of matrix transformers and inductors with improvements for high frequency excitation.

U.S. Pat. No. 4,978,906 "Picture Frame Matrix Transformer" teaches the art of matrix transformers and inductors comprising a plurality of elements placed end for end in a closed pattern. This patent also teaches that picture frame matrix transformers and inductors can be constructed in unitary structures resembling the well known "pot core" transformers and inductors.

The above patents are assigned to the same assignee as the present invention and they are incorporated herein by reference.

It is well known, but frequently overlooked, that the physical design of transformers and inductors is largely dependent on the thermal characteristics of the materials used in their construction. The magnetic core and the windings of a transformer or inductor generate heat in operation, and that heat must be conducted to ambient so that the temperature in the transformer or inductor does not exceed the temperature ratings of the materials of which it is constructed. Conventional transformers are usually chunky, and the thermal paths out of them are through multiple layers of insulating materials which often have poor thermal conductivity.

It is well known that as frequency is increased, the size of transformers and inductors can be decreased for a given volt-ampere rating, to a point. At higher frequencies, however, a number of significant losses come into play which arrest this trend, and may even reverse it. Within the conductors, skin effects and proximity effects increase the losses. Core losses also increase significantly with frequency, so much so that at some point the magnetic flux density may have to be derated so much that a design for higher frequency excitation may actually require a larger magnetic core.

Matrix transformers and inductors, and in particular picture frame matrix transformers and inductors, are very well adapted for high frequency operation, and they have superior thermal characteristics as compared to conventional transformers and inductors. Because there are few wires within any one element of the picture frame matrix transformer or inductor, proximity effects are essentially eliminated. The thermal paths are short, and the surface area to volume ratio is very high.

They may be spread out oven a larger area, so that the thermal loading is distributed.

Pot core transformers of conventional design have among the worst thermal characteristics, the windings being enclosed within the magnetic core. Heat conduction away from the windings is mostly through the magnetic core material, with a small amount conducted through the leads.

SUMMARY OF THE INVENTION

It is the object of the invention to teach an improvement to the picture frame matrix transformer and inductor constructed in a pot core like structure having features to improve heat rejection.

Because the space needed for conductors is much less in a matrix transformer, the pot core matrix transformer may be somewhat different in shape than the usual pot core transformer. The channel for the conductors may be smaller, the profile may be lower, and it may be shaped more like a ring, with a proportionately larger hole in the center.

A number of conductors exit the pot core matrix transformer, particularly those having a high equivalent turns ratio. These conductors exit in groups through openings which are at regular angular increments around the pot core transformer. As the conductors are usually copper, heat conduction through the conductors can be high. The conductors are well distributed to withdraw heat evenly, they are short, and collectively they have significant cross sectional area. If care is taken to heat sink these conductors well, the pot core matrix transformer will have the capacity to reject a large amount of heat from the windings. Temperature rise can be kept to a minimum even with very high current densities.

BRIEF DESCRIPTION OF THE FIGURES

FIG. 1 shows a pot core matrix transformer including a circuit board.

FIG. 2 shows a side view of the transformer of FIG. 1. The transformer is on a heat sink.

FIG. 3 shows a top view of the bottom magnetic core of the transformer of FIG. 1, and defines a section A—A.

FIG. 4 shows the section A—A through the bottom magnetic core of FIG. 3, and also shows a section through the top magnetic core.

FIG. 5 shows the transformer of FIG. 1 without the top magnetic core and the primary winding, showing the secondary winding in place.

FIG. 6 shows the transformer of FIG. 1 without the top magnetic core, showing the primary winding in place.

FIG. 7 shows a side view of the partly assembled transformer of FIG. 6.

FIG. 41 shows a blank striping that could be used as an alternative construction technique for the secondary winding for the transformer of FIG. 32.

FIG. 42 shows the stamping of FIG. 41 partially formed in place on the bottom magnetic core.

FIG. 43 shows the completed secondary winding using the alternative construction technique.

FIG. 44 shows a top view of another embodiment of the invention, a transformer similar to the transformer of FIG. 32 but having a secondary winding which is electrically isolated from the base. FIG. 44 also defines a section E—E.

FIG. 45 shows the section E—E of FIG. 44.

DESCRIPTION OF THE PREFERRED EMBODIMENT OF THE INVENTION

Figure 8:
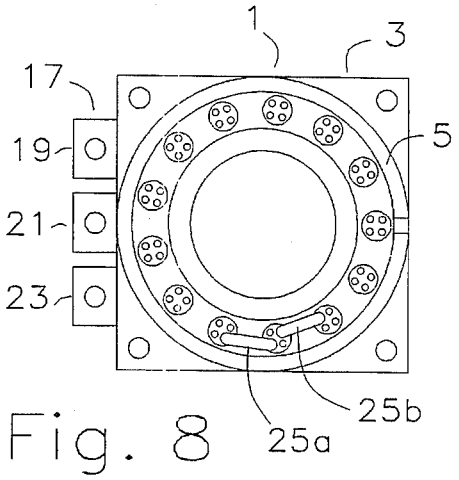
FIG. 8 shows the transformer of FIG. 5 with one segment pair of the secondary winding in place.

FIGS. 1 and 2 show a pot core matrix transformer 1 having improved heat rejection mounted on a heatsink 12. The transformer 1 comprises a bottom magnetic core 5, a top magnetic core 7, a primary winding 9 and a secondary winding 17. A circuit board 3 interconnects the secondary winding 17 and serves as a mounting base for the transformer 1. Four holes **2*a* through 2*d* in the circuit board 3 are for mounting the transformer 1 to a heatsink 12 or other structure capable of carrying heat away from the transformer 1. Mounting screws 10*a* and 10*b* hold the transformer 1 to the heatsink 12**.

The construction of the pot core matrix transformer is such that a number of descriptive terms commonly used in the jargon of the art of transformers do not apply literally, but their use is retained for this specification and the claims because they are familiar to those skilled in the art, and they have a direct correlation with the corresponding items in a transformer of conventional construction. For instance, the secondary "winding" is hardly a winding in the usual sense, not being wound around anything. Nor is the term "turn" descriptively accurate except in special cases, "turn" conventionally meaning a complete wrap of a wire around the center leg of the transformer core but having a quite different physical realization in the pot core matrix transformer. "Start" and "end" retain their conventional association with phasing, but have little physical meaning. None the less, "winding", "turns", "start", "end", "turns ratio" and so forth are used in a "black box" sense in this specification and the claims to describe the characteristics of the transformer from the point of view of the input and output relationships using the familiar jargon of the art.

The primary winding 9 has a start 11 and an end 13. The secondary winding 17 is a center-tapped winding, and has a start 19, a center-tap 21 and an end 23.

FIG. 3 shows a top view of the bottom magnetic core 5 of the transformer of FIG. 1. The bottom magnetic core 5 in this embodiment is generally annular, generally in the shape of the familiar "pot core". FIG. 4 shows a section A—A through the bottom magnetic core 5 and also through the top magnetic core 7 showing how the top magnetic core 7 is placed bridging the open top of the bottom magnetic core 5 to provide a closed magnetic flux path. The top and bottom magnetic cores are preferably made of ferrite, but either one or both could be made of a different ferromagnetic material.

The bottom magnetic core 5 has a plurality of holes **4*a*, 4*b*, . . . 4*m* in the bottom for the secondary winding 17. The holes 4*a*, 4*b*, . . . 4*m* are approximately equally spaced angularly, but that is not a necessary condition provided that the spacing between the two most closely spaced of the holes is sufficient to provide a sufficient cross sectional area for the magnetic flux. The holes 4*a*, 4*b*, . . . 4*m* are in the bottom to accommodate the design of the secondary winding 17**, but other alternative arrangements such as slots in the side wall or holes or notches in the top could be used.

The bottom magnetic core 5 has a notch 6 for the primary winding 9. The top magnetic core 7 also has a notch 8 for the primary winding 9. The notches 6 and 8 allow the primary winding 9 to exit sideways as shown, or straight up.

FIG. 5 shows a top view of the transformer 1 of FIG. 1 as it would look partially assembled with the secondary winding 17 in place. The secondary winding 17 comprises 13 pairs of winding segments **25*a*, 25*b*, . . . 25*z* which are located within the bottom magnetic core 5 and which pass through the holes 4*a*, 4*b*, . . . 4*m* to connect to the circuit board 3 and thus connect to three terminals, the start 19, the center-tap 21 and the end 23. The details of the secondary winding 17 are illustrated and discussed further later on FIGS. 6 and 7 show top and side views respectively of the transformer 1 of FIG. 1 as it would look partially assembled with the primary winding 9 in place. The primary winding 9 as shown comprises two turns of wire having a start 11 and an end 13. As shown, the primary winding 9 within the magnetic core 5 lies generally in a plane below the top edge of the bottom magnetic core 5 so that the top magnetic core 7 may be installed thereon without interference. Note, however, that the end 13 of the primary winding 9 crosses over the winding 9 above the plane of the winding 9, and that a notch 8 has been provided in the top magnetic core 7 to accommodate it. This notch 8 would allow the primary winding 9 to exit the transformer 1** straight up instead of sideways as shown.

The terms "primary" and "secondary" are used for convenience in this specification and the claims, "primary" usually designating a winding which connects to a power source and "secondary" usually designating a winding which connects to a load. The terms are arbitrary and interchangeable as most transformers are reversible, these transformers being no exception.

Figure 9:
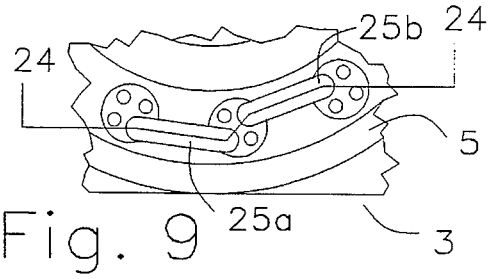
FIG. 9 shows an enlarged portion of the transformer of FIG. 8, and defines a section B—B.
Figure 10:
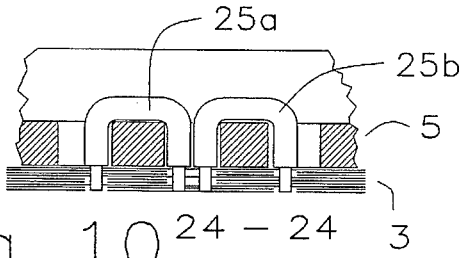
FIG. 10 shows the section B—B of FIG. 9.

To further explain the construction of the transformer 1 of FIG. 1, FIG. 8 shows the transformer subassembly of FIG. 5 with only one pair of secondary winding segments 25*a* and 25*b* installed. FIG. 9 shows the same pair of secondary winding segments 25*a* and 25*b* in enlarged detail and also defines a section B—B through the bottom magnetic core 5, the pair of secondary winding segments 25*a* and 25*b* and the circuit board 3. FIG. 10 shows the section B—B generally to scale.

Figure 11:
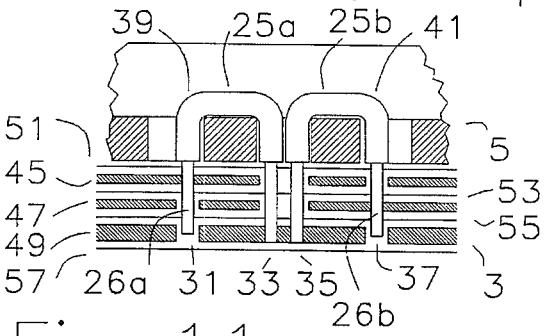
FIG. 11 shows the section B—B of FIG. 9 with the secondary winding segment pair and the circuit board shown in exaggerated vertical scale.

The circuit board 3 comprises a plurality of conducting layers separated by insulating layers. FIG. 11 shows the same section B—B as in FIG. 10 except that the circuit board 3 and the secondary winding segments 25*a* and 25*b* are shown in an exaggerated vertical scale for purposes of illustrating the arrangement and interconnection thereof.

The first secondary winding segment 25*a* may comprise a wire 26*a* having a start 31 and an end 33, and may having insulation 39 covering it. The second secondary winding segment 25*b* may comprise a wire 26*b* having a start 35 and an end 37, and may have insulation 41 covering it. The circuit board 3 may comprise three conducting layers 45, 47 and 49 and four insulating layers 51, 53, 55 and 57.

The start 31 of the first secondary winding segment 25*a* connects to the a first conducting layer 45 with solder or the like. The first conducting layer 45 extends to a terminal 19 which is the start of the secondary winding 17 as a whole. The end 33 of the first secondary winding segment 25*a* and the start 35 of the second secondary winding segment 25*b* connect to a second conducting layer 49. The second conducting layer 49 extends to a terminal 21 which is the center-tap of the secondary winding 17 as a whole. The end 37 of the second secondary winding segment 25*b* connects to a third conducting layer 47. The third conducting layer 47 extends to a terminal 23 which is the end of the secondary winding 17 as a whole.

The intermediate insulating layers 53 and 55 keep the conducting layers 45, 47 and 49 of the circuit board 3 from short circuiting. The top insulating layer 51 is desirable if the magnetic core 5 is conductive, though other means may be used. The bottom insulating layer 57 is optional, and is used if the transformer 1 is to be mounted on an electrically conductive surface and electrical isolation therefrom must be provided. If the bottom insulating layer 57 is not used, the start 31 of the first secondary winding segment 25*a* and the end 35 of the second secondary winding segment 25*b* must be prevented from short circuiting by some means if the transformer 1 is mounted to an electrically conductive mounting surface, for example by making them slightly shorter.

The circuit board 3 can be fabricated in a number of ways which would be familiar to one skilled in the art of circuit boards. One way would be to use ordinary multi-layer printed circuit board techniques with plated through holes or eyelets. This would be easy to fabricate and assemble, and would be suitable for many applications of the transformer 1. For more demanding applications, the multi-layer printed circuit board could have an extra thick layer of copper applied to the bottom to improve electrical and thermal conduction in the bottom layer. Another method would be to assemble the circuit board 3 with layers of heavy copper foil and insulating film, drilled appropriately, The choice is an engineering trade-off of a number of factors including cost, thickness, electrical and thermal requirements and ease of assembly.

The transformer 1 is shown mounted on a circuit board 3 so that its interconnecting wiring within the secondary winding 17 is complete, ready to be hooked up as any other transformer would be with conventional transformer terminations 11, 13, 19, 21 and 23. However the circuit board 3 need not be installed. The various parts comprising a transformer subassembly could be fixtured and potted or otherwise secured in place without the circuit board 3. The transformer would then have a plurality of pin leads protruding from the bottom of the bottom magnetic core 5. This could be installed in a printed circuit board as any other component would be. It is a well established art to build circuit boards with enhanced thermal conductivity, and such a circuit board would work well with this invention.

The interconnection of the Secondary winding segments 25*a* and 25*b* to the circuit board 3 is replicated in the remaining 12 pairs of secondary winding segments 25*c* through 25*z*, each pair displaced angularly by one hole. Each pair similarly bas a start, a center-tap and an end. In each hole 4*a*, 4*b*, . . . 4*m* there is the end for one pair, the center-tap for the next pair and the start for the next yet, overlapping in a closed pattern around the bottom magnetic core 5 in the manner of a picture frame matrix transformer. The thirteen starts of the thirteen pairs of the secondary winding segments all terminate in the first conductive layer 45 and are thus connected in parallel outside the magnetic core and are collectively; connected to comprise the start 19 of the secondary winding 17. Similarly the thirteen center-taps of the thirteen pairs are all terminated in the second conductive layer 49, and are thus connected in parallel to comprise the center-tap 21 of the secondary winding 17. Similarly the thirteen ends of the thirteen pairs are all terminated in the third conductive layer 47, and are thus connected in parallel to comprise the end 23 of the secondary winding 17.

Although a circuit board 3 with three conductive layers is shown, this is for illustration and not as a limitation. Different designs and requirements would use different numbers of conductive layers, for example, a single secondary winding would use two conductive layers while a split secondary winding would require four conductive layers. Additional secondaries windings may also be provided, increasing the number of conductive layers necessary. The primary winding 9 could also connect through the circuits board 3 to terminals, requiring additional conductors therein.

Figure 12:
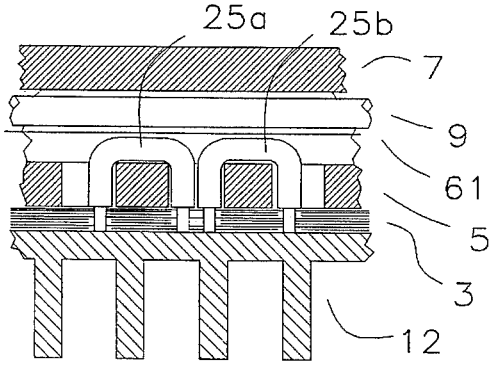
FIG. 12 shows the primary winding and the top magnetic core added to the section B—B of FIG. 10, and also shows a section of the heatsink.

FIG. 12 shows the section B—B of FIG. 10 with the addition of the top magnetic core 7, the primary winding 9 and an optional insulating layer 61. The transformers is shown installed on a heat sink 12.

The thermal paths for heat conduction out of the transformer 1 can be seen readily by reference to FIGS. 1, 11 and 12. The transformer 1 is intended to mount upon a heat sink 12 or other structure having a capacity to conduct and dissipate heat so that the bottom of the circuit board 3 is in good thermal contact therewith. Usual means to improve thermal conduction such as thermal compound may be used.

Often the electrical circuits must be isolated electrically from the heat sink 12, in which case an electrically insulating layer 57 will be used, either incorporated into the construction of the transformer 1 or as a loose part installed When the transformer 1 is put on the heat sink 12. Sometimes a "live" heat sink is used, in which case the heat sink is in electrical contact with the component being heat sunk. If this is the case, the electrically insulating layer 57 need not be used, and the second conductive layer 49 would mount in direct contact with the heat sink 12.

The second conductive layer 49 was purposefully put closest to the bottom surface of the circuit board 3, but that is discretionary, and other designs might be different. Notice that both parts of the pair of secondary winding segments 25*a* and 25*b* terminate at the second conductive layer 49, and comprise the center-tap of the secondary winding 17. The other conductive layers 45 and 47 each contact only one part of each pair. Thus the center-tap is preferred as the bottom layer because it is in intimate thermal contact with more parts of the secondary winding 17. Also in a transformer the center-tap 21 is usually designed to carry twice the RMS. current of either the start 19 or the end 23. Within the circuit board 3 at the connection to the secondary winding segments 25*a* and 25*b*, the center-tap connection comprising the end 33 and the start 35 must also together carry twice the current as the start 31 and the end 37. This is true also for all of the other pairs of secondary winding segments 25*c* through 25*z*.

In this embodiment, it is obvious that the center-tap will have twice the area, it being two wires 26*a* and 26*b*. This is not the only way to construct the center-tap, however. The segments could be connected within the magnetic core 5 with a single conductor running from the connection to the second conductive layer 49. The single conductor should, however, have twice the current capacity, and therefore will tend to have at least twice the cross sectional area of the other conductors.

Another reason favoring the choice of the second conductive layer 49 as the bottom conductive layer is that in many full wave rectified circuits, this point in the electrical circuit may be common to one polarity of the output voltage, and thus is a good candidate for being electrically common to a live heat sink.

In some designs it may be desirable to have additional conductive layers. Examples would be a for a split winding or for additional secondaries for additional output voltages. It is preferred to identify the conductors having the best thermal conduction from the inside of the transformer and to bring these conductors to the bottom layer for good heat sinking. It may also be desirable to have one or more additional layers which are electrically common. For instance, an additional conductive layer with the same electrical connections as the second conductive layer 49 might be placed between the other conductive layers 45 and 47 to form an interleaved conductor. An additional conductive layer could be used on top of the circuit board 3, perhaps as shielding for EMI (electro-magnetic interference). Additional insulating layers would be used as necessary.

It is readily apparent from inspection FIG. 11 that the construction illustrated and discussed above provides superior heat conduction from each secondary winding segment 25*a*, 25*b*, . . . 25*z* to a heat sink through the second conductive layer 49. This connection, however utilizes only half of the conductors from the inside of the transformer 1. Heat rejection capacity can be improved significantly if the remaining leads also have good heat sinking. This can be accomplished if the first and third conductive layers 45 and 47 can conduct heat to the second conductive layer 49 and then to the heat sink 12. Because the three conductive layers 45, 47 and 49 are parallel and have large areas. thermal conduction between them will be good if the intervening insulating layers 53 and 55 are thin, have good thermal conductivity, and are bonded without voids to the conductive layers 45, 47 and 49. Circuit boards with such characteristics are well known and can be adapted for use with the pot core matrix transformer. Good heat sinking for the bottom magnetic cone 5 is also desirable, suggesting that the insulating layer 51 should also be thin, have good thermal conductivity and be bonded without voids to the bottom magnetic core 5 and the first conductive layer 45.

With reference to FIGS. 6 and 12 it can be seen that the thermal path for the primary winding 9 is not as direct. Some heat may be conducted lengthwise through the start 11 and the end 13, but this path need not be relied upon as the principle heat rejection means. It can be seen that the primary circuit 9 lies above and close to the secondary winding segments 25*a*, 25*b*, . . . 25*z*. By taking measures to improve the thermal conductivity from the primary winding 9 to the secondary winding segments 25*a*, 25*b*, . . . 25*z*, effective heat sinking of the primary winding can be achieved. The number of layers of insulation between the primary winding 9 and the secondary winding 17 and their thickness may be dictated by agency requirements or the electrical withstanding voltage required. It is preferred that the electrical insulation used have good thermal conductivity, be as thin as is allowed and that minimum voids be allowed in the thermal path. Potting with a good thermal potting material may be beneficial.

Figure 13:
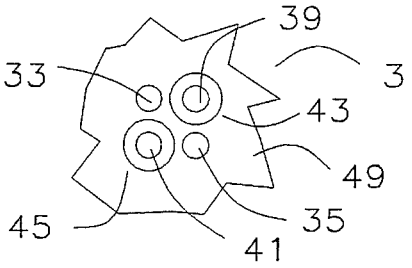
FIG. 13 shows a bottom view of a portion of the circuit board with an enlarged detail of the transformer interconnection to the circuit board.

FIG. 13 shows a view of a small portion of the bottom of the circuit board 3 without the bottom insulating layer 57, showing the cluster of connections in registrations with one of the holes 4*a*, 4*b*, . . . 4*m* of the bottom magnetic core 5. The seconding conducting layer 49 is visible, as are the end 33 and the start 35 which are soldered into the conducting layer 49. In the same cluster are the ends 39 and 41 of two other secondary winding segments with clearance holes 43 and 45 surround them for electrical isolation.

With reference to FIGS. 11 and 13, heat generated within the transformer 1 is conducted out principally through the leads, for example, the end 33 and the start 35. From the ends of the leads, the heat must spread out through the second conducting layer 49. It can be seen that the clearance holes 43 and 45 for the leads 39 and 41 interrupt the heat flow path away from the end 33 and start 35 in the conductive layer 49 and increase the heat flux density (as well as the current density) in the vicinity of the interconnections, just where it is most critical. The assembly shown in FIGS. 5 and 8 through 13 require soldering from the bottom, (as is normal for a through-hole circuit board) The small clearance around the leads 39 and 41 could pose a problem with solder bridging, and the leads 39 and 41 must be below flush and/or insulated. These problems are manageable with good manufacturing techniques and quality control.

Figure 14:
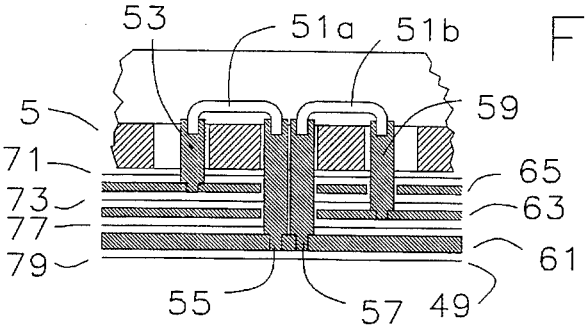
FIG. 14 shows a section of another method of interconnecting the secondary winding to a circuit board.

FIG. 14 shows an alternative construction. The same bottom magnetic core 5 may be used, but the circuit board 49 is of different design. As in FIG. 11, the vertical scale of FIG. 14 is exaggerated to more clearly show the details. In actual practice, the circuit board 49 would be reasonably thin, and the layers thereof would be closely spaced and bonded without voids. Instead of having through holes, the conductive layers 61, 63 and 65 have posts 53, 55, 57 and 59 installed therein. The posts 53, 55, 57 and 59 could be screw machine parts and could be attached to the conductive layers 53, 57 and 59 by welding, brazing, silver soldering or the like. The circuit board 49 is then assembled with insulating layers 71, 73, 77 and 79 used as necessary. The posts 53, 55, 57 and 59 extend upward sufficiently so that they extend through the holes in the bottom of the bottom magnetic core 5. The secondary winding segments 51*a*, 51*b* of the secondary winding are then soldered into the posts 53, 55, 57 and 59 from the top. The posts 53, 55, 57 and 59 and the secondary winding segments 51*a* and 51*b* are understood to be parts of a complete set, and the finished secondary winding would resemble the secondary winding 17 of FIG. 5.

The assembly of FIG. 14 has improved thermal conduction because the posts 53, 55, 57 and 59 are larger in cross section than the wires 26*a* and 26*b* of FIG. 11, and the bottom conductive layer need not be perforated. The posts 53, 55, 57 and 59 could alternatively have the cross section of a quarter-round so that they would adjoin in a full circle to take maximum advantage of the area of the holes 4*a*, 4*b*, . . . 4*m* in the bottom of the bottom magnetic core 5. Of course, they must be electrically isolated from each other and the magnetic core as by a film of insulation.

Figure 15:
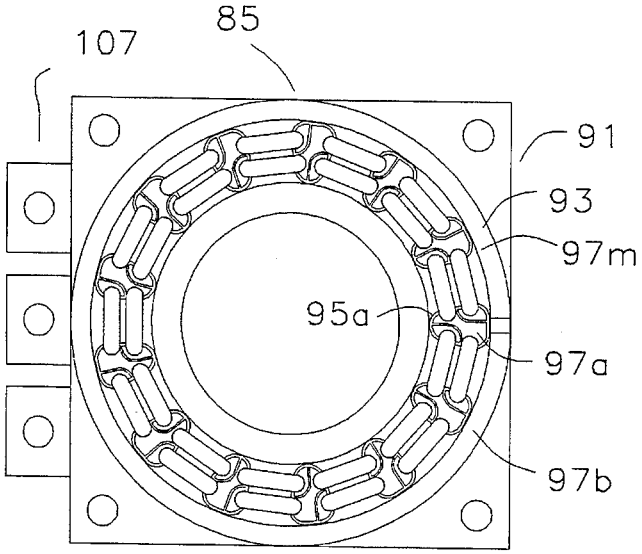
FIG. 15 shows a top view of another embodiment of the secondary winding.
Figure 16:
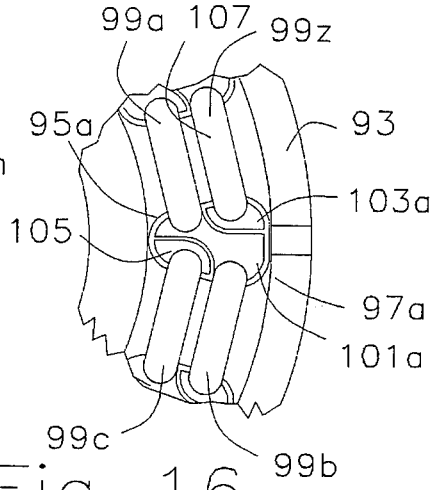
FIG. 16 is an enlarged portion of FIG. 15.
Figure 17:
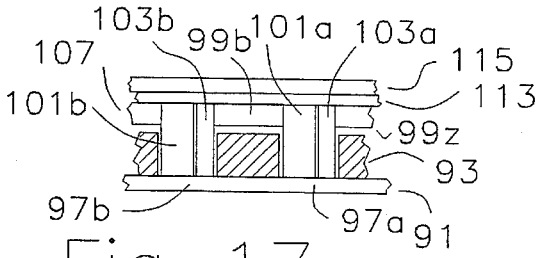
FIG. 17 shows a section through the transformer subassembly of FIG. 15 with a portion of the primary winding added.
Figure 18:
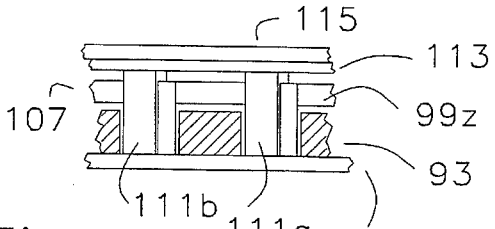
FIG. 18 shows a section through another embodiment of the transformer subassembly of FIG. 15.

FIGS. 15 through 18 show a partly assembled transformer 85 which is a variant of the assembly of FIG. 14. FIG. 16 shows an enlarged portion from FIG. 15. FIG. 17 shows a section through a portion of the transformer 85 and shows a method of heat sinking the primary winding 115. FIG. 18 shows another method of mounting and heat sinking the primary winding 115.

A bottom magnetic core 93 is located on a circuit board 91. A plurality of posts 97*a*, 97*b*, . . . 97*m* are integral with and extend up from the circuit board 91 through holes 95*a*, 95*b*, . . . 95*m* in the bottom of the bottom magnetic core 93. A plurality of bars 99*a*, 99*b*, . . . 99*z* are soldered into notches 101*a*, 101*b*, . . . 101*zz*, in the posts 97*a*, 97*b*, . . . 97*m* to complete the secondary winding 107. With reference to FIG. 16, it can be seen that the post 97*a* comprises three parts 101*a*, 103*a* and 105 which are to be understood to be insulated from each other and the bottom magnetic core 93 such as by insulating film. The first part 101*a* of the post 97*a* is the center-tap connection, and the other two parts 103*a* and 105 comprise the start and the end respectively of adjoining segments of secondary winding 107. This construction has the advantage that the cross sectional area of the posts 97*a*, 97*b*, . . . 97*m* has been enlarged for better heat conduction, and, as can be seen in FIGS. 16 and 17, the top surface of the secondary winding 107 within the transformer 85 is wide and flat for improved heat transfer from the primary winding 115.

Because of the large number of posts or wires leaving the transformer core and their collective area is large, the secondary winding tends to be very well heat sunk. The heat sinking of the primary winding, however, is largely dependent upon heat conduction to the secondary winding through the primary winding insulation, the secondary winding insulation and any intervening insulation and voids. For ordinary dielectric materials, the thermal impedance would be quite high. This would be adequate for many applications, none the less, and would compare very favorably with transformers of conventional construction.

FIG. 17 shows a technique for enhancing the heat sinking of the primary winding 115. The primary winding 115 is soldered to an insulator 113. The insulator 113 is then soldered to the secondary winding 107 and the top of posts 97*a* and 97*b* which conduct heat away.

Solder, being a metal, is particularly good as a bonding agent for connecting parts so as to have low thermal impedance. The insulating material of the insulator 113 is preferably metalized to received the solder, and the metalization must be arranged and disposed so that the neither the primary winding 115 nor the secondary winding 107 is short circuited. This can be accomplished by etching the metalization on the insulator 113 in a pattern which will conform to the patterns of the windings.

There are a number of insulating materials which have good thermal conduction and which can be metalized, among them several proprietary high thermal conductivity circuit board materials and ceramics such as beryllium oxide, alumina or aluminum nitride. The insulator 113 could be a continuous ring conforming to the path of the primary winding 115, or, alternatively, the insulator 115 could comprise a series of discs or pads above the posts 97*a* and 97*b*.

FIG. 18 shows another embodiment of the transformer 85 of FIGS. 15 through 17, in which the primary winding 115 and the insulator 113 is elevated above the secondary winding 107. With reference to FIGS. 15 through 17, it can be seen that the posts 111*a* and 111*b* of FIG. 18 correspond to the posts 101*a* and 101*b* except that they are somewhat taller. This increase in height is an optional feature, so that the metalization for soldering on the bottom of the insulator 113 is less critical as to location, pattern and registration.

Figure 19:
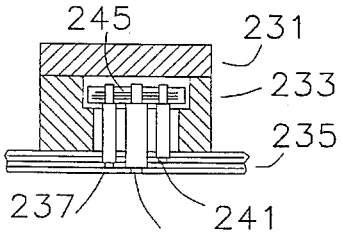
FIG. 19 shows a section through a transformer showing that the primary and secondary windings can comprise a circuit card mounted upon pins which extend upward from a circuit board through the bottom magnetic core.

FIG. 19 shows that the windings of the transformer can be fabricated as a circuit card 245. Transformer windings are often fabricated as multi-layer circuit cards, particularly in planar transformers. The terminations to the circuit card are usually at the edges of the circuit card, and the heat sinking through the terminal connections is generally marginal. In this invention as shown in FIG. 19, the circuit card 245 is terminated using a plurality of posts 237, 239 and 241 which pass through holes in the bottom:magnetic core 233 to a circuit board 235.

The circuit board 235 may be made as shown in FIG. 14 so as to have excellent heat sinking characteristics. The posts 237, 239 and 241 shown are one set of many, generally disposed around the transformer as in the earlier examples. A top magnetic core 231 completes the magnetic flux path around the windings.

Figure 20:
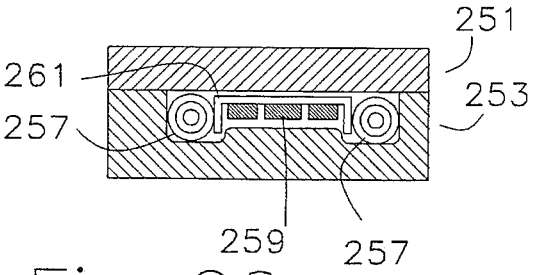
FIG. 20 shows that the transformer can have a lower profile if the primary and secondary windings are on the same plane.

FIG. 20 shows that the transformer may have a lower overall profile if the primary winding 257—257 is mounted in the same plane as the secondary winding 259. In this example, the secondary winding 259 is on a circuit card 261 which may be of material having good thermal conduction. The circuit card 261 may extend to the primary winding 257 to heat sink it. The edge Of the circuit card 261 may be extended downward as shown to provide an additional dielectric barrier between the primary 257 and the secondary 259 and also to provide a greater surface area to receive heat flux from the primary 257. The transformer may be potted to provide insulation for the secondary winding 259.

Note that the bottom magnetic core 253 is stepped. In a transformer having high dielectric isolation, the insulation thickness requirements for the primary 257, if it is a higher voltage, may be substantially more than for the secondary 259. On the other hand, the secondary winding 259 is above an area in the bottom magnetic core 253 where there are a plurality of holes. Between the holes, the bottom magnetic core may have to be thicker so provide the same cross sectional area for the magnetic flux. Thus it may be advantageous to analyze the magnetic flux density in the bottom magnetic core 253 and the top magnetic core 251 as a trade off against other factors such as height.

The magnetic flux path is around the windings, following the magnetic core in the plane of the drawing of FIG. 20. If the whole transformer is circular, the magnetic flux density will tend to be high just outside of the center post in the flat part of the top and bottom magnetic cores as well as in the vicinity of openings. An arrangement of the windings that allows sections with high magnetic flux density to be somewhat thicker is preferred. Additional heat sinking may also be needed for the core in areas of higher flux density.

FIGS. 21 through 31 show another embodiment of the invention. A transformer 201 comprises a top magnetic core 203, a bottom magnetic core 205, a primary winding 207 and a secondary winding 209. The transformer 201 is designed to be mounted by surface mounting it on a circuit board 211.

Figure 21:
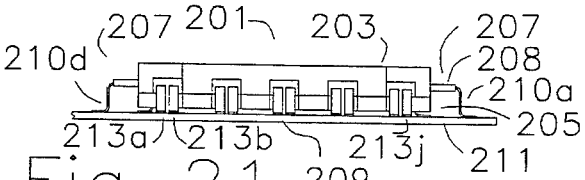
FIG. 21 shows a side view of another embodiment of the invention which is a transformer designed for surface mounting.

FIG. 21 shows a side view of the transformer 201. The surface mount leads 213*a*, 213*b*, . . . 213*j* visible on the side are part of the secondary winding 209 and comprise the start and end terminals thereof. The exact layout of the winding will vary from application to application, but for a center-tapped secondary winding, the overall connections will be similar to the other examples above. The primary winding 207 comprises a circuit board 208 which can be seen extending from the ends of the transformer 201 terminating in surface mount leads 210*a* and 210*d*.

Figure 22:
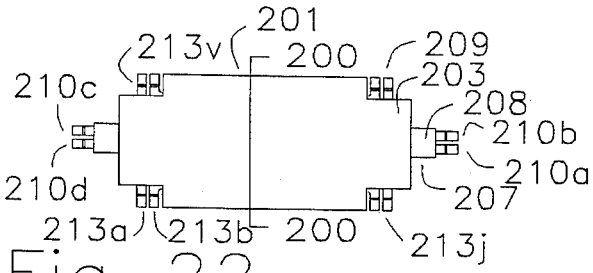
FIG. 22 shows a top view of the transformer of FIG. 21.

FIG. 22 shows a top view of the transformer 201, and defines a section D—D through the transformer 201. Most of the surface mount leads 213*a* through 213*v* of the secondary winding 209 are hidden by the top magnetic core 203, but some of the surface mount leads are visible in the corners where the top magnetic core 203 is notched. The circuit card 208 comprising the primary winding 207 can be seen extending from the ends of the transformer 201, terminating in the surface mount leads 210*a* through 210*d*.

The circuit card 208 extends well beyond the body of the transformer 201 to provide sufficient creepage distance. In some applications, the leads 210*a* through 210*d* could be closer to the body of the transformer 201.

Figure 23:
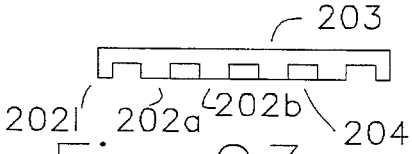
FIG. 23 shows a side view of the top magnetic core of the transformer of FIG. 21.
Figure 24:
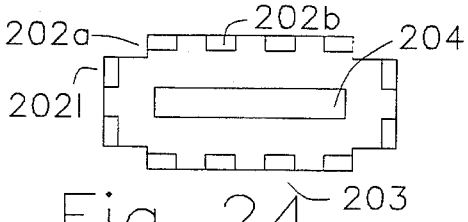
FIG. 24 shows a bottom view of the top magnetic core of FIG. 23.
Figure 25:
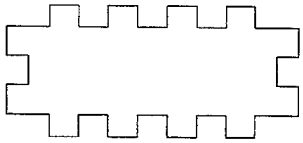
FIG. 25 shows a top view of the bottom magnetic core of the transformer of FIG. 21.
Figure 26:
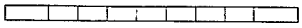
FIG. 26 shows a side view of the bottom magnetic core of FIG. 25.

FIGS. 23 and 24 show a side view and bottom view respectively of the top magnetic core 203. A plurality of peripheral posts 202*a*, 202*b*, . . . 202*l* extend downward. A center post 204 also extends downward. FIGS. 25 and 26 show a top view and a side view respectively of the bottom magnetic core 205. When mated together, the top magnetic core 203 and the bottom magnetic core 205 provide a closed magnetic flux path for the transformer 201 through the center post 204 and returning through the plurality of peripheral posts 202*a*, 202*b*, . . . 202*l*.

Figure 27:
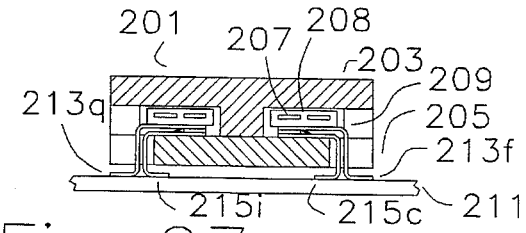
FIG. 27 shows a section through the transformer of FIG. 21.

FIG. 27 shows the section D—D through the transformer 201. The surface mount leads 213*f* and 213*q* are soldered to the circuit board 211, and are part of the secondary winding 209. Two other visible surface mount leads 215*c* and 215*i* are center-taps of the secondary winding 209. As in the other examples of the other matrix transformers, the several starts, center-taps and ends of the secondary winding 209 are paralleled within the circuit board 211. The circuit board 211 could be dedicated as a terminal board for the transformer 201 in the manner of circuit board 3 in FIGS. 1 through 12, or it could be part of a larger circuit to which the transformer 201 is interconnected.

Figure 28:
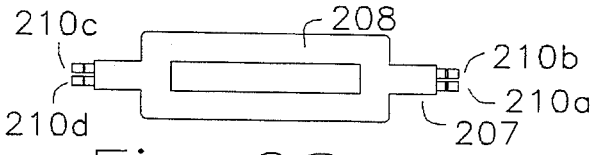
FIG. 28 shows the primary, comprising a circuit card with surface mount terminations.

FIG. 28 shows the circuit card 208 Comprising the primary winding 207. Surface mount leads 210*a* through 210*d* provide the termination for the primary winding 207. The circuit card 208 may comprise etched conductors in any of a variety of patterns depending upon the primary configuration, and will also comprise one or more insulating layers as in usual in the art of circuit board construction. For use in a transformer, the circuit board 208 will preferably be fabricated of insulation material having good thermal conduction, and a sufficient number of layers will be used to meet the electrical requirements for dielectric withstanding voltage, as would be well understood by one skilled in the art. More or fewer terminals may be needed for the primary 207 depending upon the configuration.

Figure 30:
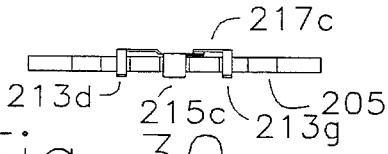
FIG. 30 shows a side view of the bottom magnetic core with one piece of the secondary winding installed.
Figure 29A:
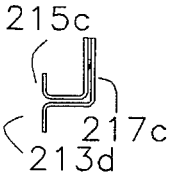
FIG. 29 shows a side and top view of a piece of the secondary winding.
Figure 29B:
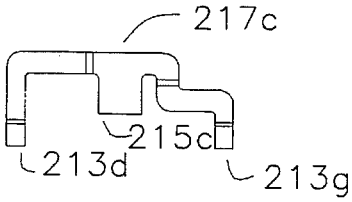
Figure 31:
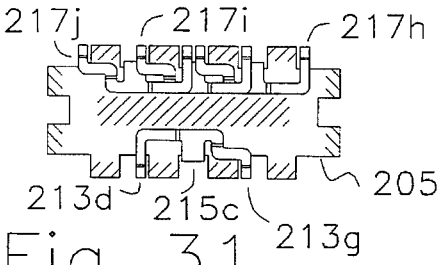
FIG. 31 shows a top view of the bottom magnetic core with four pieces of the secondary winding installed.

FIGS. 29 through 31 show an example of an approach which could be used to fabricate the secondary winding 209. The secondary winding could be made of a plurality of formed metal stampings 217 which preferably are made of metal and are preferably covered with an insulating film except at the surface mount contacts 213*d*, 213*g* and 215*c*. FIG. 29 shows a side view and a top view of the stampings 217*c*. Because several of these stampings are used in an overlapping arrangement, the stampings must jog up and down for clearance.

FIG. 30 shows a side view of the bottom magnetic core 205 with a single stamping 217*c* installed, comprising one segment of the secondary winding 209. The stamping 217*c* is preferably bonded to the bottom magnetic core 205 so as to control the alignment of the surface mount leads 213*c*, 213*g* and 215.

FIG. 31 shows a top view of the bottom magnetic core 205 with four stampings 217*c* and 217*h* through 217*j* installed. The stamping 217*c* is shown alone to clearly show the start 213*d*, the center-tap 215*c* and the end 213*g*. On the other side three more stampings 217*h* through 217*j* are installed, showing the overlapping arrangement. It is to be understood that several more stampings are necessary to complete the secondary winding 209. Some of the stampings have a different shape, but they are equivalent functionally. The cross hatched area shown on the bottom magnetic core 205 represents the foot print of the top magnetic core 203. This area must be kept open to allow the unencumbered installation of the top magnetic core 203.

The circuit card 211 upon which the transformer 201 is mounted is preferably constructed of materials having good thermal conductivity and should have a low thermal impedance to a suitable heat sink or other surface capable of sinking and dissipating heat.

Figure 32:
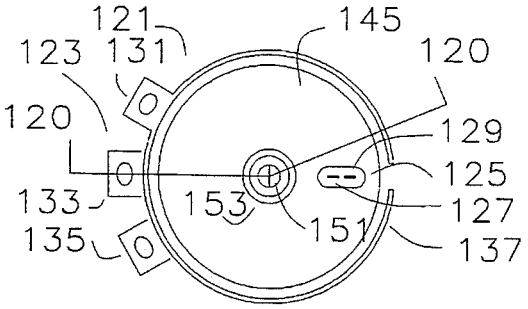
FIG. 32 shows another embodiment of the invention, a transformer having circumferential rings to connect in parallel the starts and the ends of the segments of the secondary winding.
Figure 34:
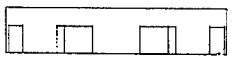
FIG. 34 shows a side view of the top magnetic core of the transformer of FIG. 32.
Figure 35:
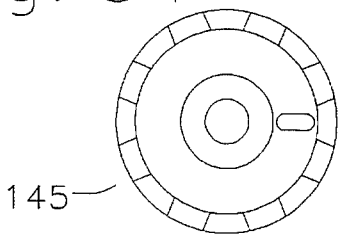
FIG. 35 shows a bottom view of the top magnetic core of FIG. 34.
Figure 33:
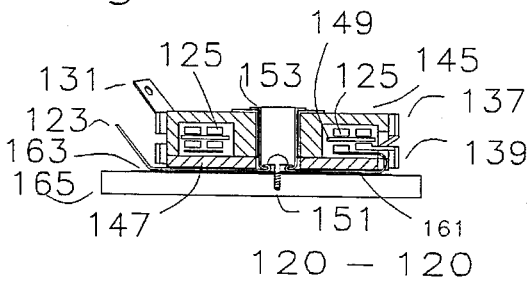
FIG. 33 shows a section of the transformer of FIG. 32. The center-tap connection for the secondary winding is a metal stamping covering the bottom of the transformer, for heat sinking.
Figure 36:
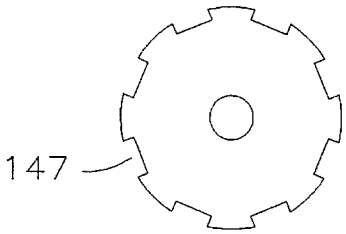
FIG. 36 shows a top view of the bottom magnetic core of the transformer of FIG. 32.
Figure 37:
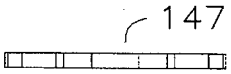
FIG. 37 shows a side view of the bottom magnetic core of FIG. 36.

FIGS. 32 and 33 show a top view and a section C—C of a transformer 121 having a primary winding 125 and a secondary winding 123. The primary winding 125 may have a start 127 and an end 129. The secondary winding 123 may have a start 131, a center-tap 133 and an end 135. The transformer 121 has a top magnetic core 145 and a bottom magnetic core 147. A screw 151 may be used to hold the transformer 121 on a heat sink 165. An insulator 163 may insulate the transformer 121 from the heatsink 165.

The center-tap 133 of the secondary winding 123 comprises a continuous metal stamping 161 which covers the bottom of the transformer 121, and thus provides the surface from which heat is conducted to the heatsink 165. A retainer 153 conforms to the inside diameter of the top magnetic core 145 and extends to the metal stamping 161 to hold the transformer 121 together and to provide heat sinking for the inside and top inside edge of the top magnetic core 145.

FIGS. 34 through 37 show, respectively, a side and bottom view of the top magnetic core 145 and a top and side view of the bottom magnetic core 147.

Figure 38:
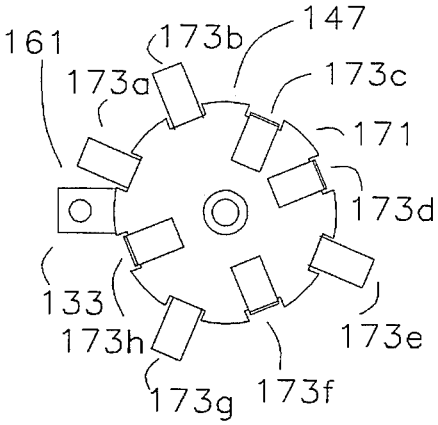
FIG. 38 shows a top view of the bottom magnetic core with the stamping for the center-tap partly installed thereon.

FIG. 38 shows a subassembly 171 of the transformer 201 comprising the bottom magnetic core 147 and the metal stamping 161, shown partially formed. Tabs 173*a*, 173*b*, . . . 173*h* extend from the metal stamping 161 and are folded up around the edge and over the top of the bottom magnetic core 147. Just as there are a number of posts in the earlier examples of the pot core matrix transformer, there are a number of these tabs 173*a*, 173*b*, . . . 173*h*, Teach providing both a connection for the center-tap 133 of the secondary winding 123 and also providing a good thermal path out of the transformer 121.

Figure 39:
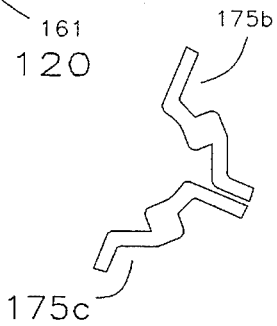
FIG. 39 shows two of the pieces of the secondary winding.
Figure 40:
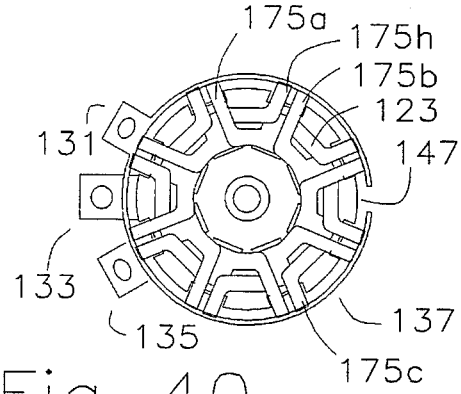
FIG. 40 shows the bottom magnetic core with the secondary winding installed thereon as a subassembly of the transformer of FIG. 32.

FIG. 39 shows two secondary stampings 175*b* and 175*c* which may be used to fabricate the secondary winding 123. FIG. 40 shows a plurality of the secondary stampings 175*a*, 175*b*, . . . 175*h* soldered to the subassembly 171 to comprise the secondary winding 123.

The start 131 and the end 132 of the secondary winding 123 are connected to circumferential rings 137 and 139 to which the starts and ends respectively of the secondary stampings 175*a*, 175*b*, . . . 175*h* of the secondary winding 123 are connected in parallel. The center-tap 133 comprises the metal stamping 161 and is attached to the center-tap of each of the secondary stampings 175*a*, 175*b*; . . . 175*h*. The metal stamping 161 and the circumferential rings 137 and 139 thus have the same function as the circuit board 3 of FIGS. 1 through 12.

FIG. 41 shows another stamping 177 which may replace the metal stamping 161 of the transformer 121 of FIGS. 32 through 40. As shown in FIG. 42, the tabs 179*a*, 179*b*, . . . 179*h* extending from the alternate stamping 177 may be folded and formed around the bottom magnetic core 147 to make the secondary winding. With reference to FIGS. 41 and 42, tab 179*c* is partly formed, having its tips 181 and 183 bent downward. Tab 179*d* is formed to a next step, being bent straight up near the edge of the bottom magnetic core 147. Tab 179*e* is formed to the next step, being bent down along the top of the bottom magnetic core 147. Tab 179*a* shows the final forming step. Note that the plane view of the tab 179*a* resembles the outline of the secondary stamping 175*a* of FIG. 40, and is functionally equivalent to it.

FIG. 43 shows the completed secondary winding 181 which is functionally equivalent to the secondary winding 123 of the transformer 121 of FIGS. 32 through 40.

FIGS. 44 and 45 show another embodiment of the invention. A transformer 301 comprises a secondary winding 303, a primary winding 311, a top magnetic core 317 and a bottom magnetic core 319. The secondary winding 303 may have a start 305, and center-tap 307 and an end 309. The primary winding 311 may have a start 313 and an end 315. A screw 359 may hold the transformer 301 on a heat sink 361.

A continuous metal stamping 341 extends across the bottom of the transformer 301 and has tabs that fold up and over the bottom magnetic core, just as in FIG. 38. A first insulator 331 separates the metal stamping 341 from the secondary winding 303. A second insulator 333 separates the secondary winding 303 from the primary winding 311.

With little modification, a second stamping similar to the continuous metal stamping 341 could be put on the top magnetic core 317 as well, insulated from the primary 311, so as to conduct more heat from the transformer to a second heat sink which would be placed on top of the transformer, in the manner of a "hockey puck" style semiconductor.

The first and second insulators 331 and 333 are preferably made of material having very good thermal conductivity. The secondary winding 303 is interconnected peripherally to "C" shaped metal stampings 321*a*, 321*b* and 321*c* which are, respectively, the start 305, the center-tap 307 and the end 309 of the secondary winding 303.

FIG. 45 shows the secondary winding 303, the primary winding 311, the first and second insulators 331 and 333 and the "C" shaped metal stampings 321*a*, 321*b* and 321*c* in exaggerated vertical scale. The first and second insulators 331 and 333 and the primary and secondary windings 311 and 303 may comprise a circuit card in the manner of FIG. 19. Regardless of the details of construction, they are preferably closely spaced and bonded with minimum voids for good thermal conduction, it being understood that the parts are electrically insulated to the extent necessary as by an insulating film or insulating layers of a circuit card or the like.

For this specification and the claims, the term "transformer" is used in a generic sense to include all static or moving devices in which windings and/or parts of windings are coupled by magnetic induction, including but not limited to transformers, auto-transformers, current transformers, current limiting transformers, fly-back transformers, inductors, coupled inductors, power transformers, rotary transformers and so forth to which the teachings of this invention may be applicable.

I claim:

1. A transformer having improved heat rejection comprising:

a top magnetic core, a bottom magnetic core, at least a first winding, and a circuit card, the circuit card comprising at least one conductive layer, the top magnetic core being assembled to the bottom magnetic core and together having therein an enclosed channel enclosing therein at least the at least a first winding, the top magnetic core and the bottom magnetic core further being assembled to the circuit card, at least one of the top magnetic core and the bottom magnetic core further having a plurality of openings from the enclosed channel, the plurality of openings being spaced at regular intervals along the enclosed channel, the at least a first winding having a plurality of interconnections passing through the plurality of openings to interconnect the at least a first winding with the at least one conductive layer of the circuit card, the interconnections being short and stout for good thermal conductivity from the at least a first winding to the at least one conductive layer of the circuit card the circuit card further having a mounting surface for mounting on a heat sink the at least one conductive layer of the circuit card being adjacent to the mounting surface for good thermal conductivity therebetween, whereby heat generated within the at least a first winding and heat conducted into the at least a first winding will be conducted to the heat sink.

2. A transformer having improved heat rejection comprising:

a top magnetic core, a bottom magnetic core, at least a first winding, and a plurality of terminals, the top magnetic core being assembled to the bottom magnetic core and together having therein an enclosed channel enclosing therein at least the at least a first winding, the top magnetic core and the bottom magnetic core further being assembled to the plurality of terminals, at least one of the top magnetic core and the bottom magnetic core further having a plurality of openings from the enclosed channel, the plurality of openings;being spaced at regular intervals along the enclosed channel, the at least a first winding having a plurality of interconnections passing through the plurality of openings to interconnect the at least a first winding with the plurality of terminals, the interconnections being short and stout for good thermal conductivity from the at least a first winding to the plurality of terminals the plurality of terminals further being arranged and disposed for mounting to a circuit card which has a thermal path having low thermal impedance to a heat sink, whereby heat generated within the at least a first winding and heat conducted into the at least a first winding will be conducted to the heat sink.

3. A transformer having improved heat rejection comprising:

a top magnetic core, a bottom magnetic core, at least a first winding, and a mounting plate, the mounting plate being of material having a low thermal impedance, the mounting plate further having a plurality of thermal conduits extending therefrom, the top magnetic core being assembled to the bottom magnetic core and together having therein an enclosed channel enclosing therein at least the at least a first winding, the top magnetic core and the bottom magnetic core further being assembled to the mounting plate, at least one of the top magnetic core and the bottom magnetic core further having a plurality of openings from the enclosed channel, the plurality of openings being spaced at regular intervals along the enclosed channel.

the plurality of thermal conduits passing through the plurality of openings so as to terminate proximate to the at least a first winding, the thermal conduits being short and stout for good thermal conductivity from the at least a first winding to the mounting plate the mounting plate further having a mounting surface for mounting on a heat sink whereby heat generated within the at least a first winding and heat conducted into the at least a first winding will be conducted to the heat sink.

4. The transformer of claim 1 further comprising at least a second winding and at least a first insulator the at least a first insulator being made of a material having a low thermal impedance the at least a first insulator further being between and in good thermal contact with the at least a first winding and the at least a second winding whereby heat generated within the at least one second winding will be conducted to the heat sink.

5. The transformer of claim 4 wherein the at least a first insulator has metal deposited on at least a first surface thereof, and at least one of the at least a first winding and the at least a second winding is soldered to the metal.

6. The transformer of claim 2 further comprising at least a second winding and at least a first insulator the at least a first insulator being made of a material having a low thermal impedance the at least a first insulator further being between and in good thermal contact with the at least a first winding and the at least a second winding whereby heat generated within the at least one second winding will be conducted to the heat sink.

7. The transformer of claim 6 wherein the at least a first insulator has metal deposited on at least a first surface thereof, and at least one of the at least a first winding and the at least a second winding is soldered to the metal.

8. The transformer of claim 3 further comprising at least a second winding and at least a first insulator the at least a first insulator being made of a material having a low thermal impedance the at least a first insulator further being between and in good thermal contact with the at least a first winding and the at least a second winding whereby heat generated within the at least one second winding will be conducted to the heat sink.

9. The transformer of claim 8 wherein the at least a first insulator has metal deposited on at least a first surface thereof, and at least one of the at least a first winding and the at least a second winding is soldered to the metal.

* * * * *